US010439303B2

(12) United States Patent
Boisnier et al.

(10) Patent No.: US 10,439,303 B2
(45) Date of Patent: Oct. 8, 2019

(54) INSULATOR FOR A PIVOTABLE ELECTRICAL CONNECTION

(71) Applicant: SAFRAN ELECTRICAL & POWER, Blagnac (FR)

(72) Inventors: Benjamin Boisnier, Colomiers (FR); Philippe Garcia, Saint Orens de Gameville (FR); Jean-Claude Bertet, Plaisance du Touch (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 0 days.

(21) Appl. No.: 15/744,549

(22) PCT Filed: Jul. 8, 2016

(86) PCT No.: PCT/FR2016/051747
§ 371 (c)(1),
(2) Date: Jan. 12, 2018

(87) PCT Pub. No.: WO2017/009559
PCT Pub. Date: Jan. 19, 2017

(65) Prior Publication Data

US 2018/0205160 A1 Jul. 19, 2018

(30) Foreign Application Priority Data

Jul. 16, 2015 (FR) ..... 15 56709

(51) Int. Cl.
*H01R 9/22* (2006.01)
*H01R 4/34* (2006.01)
(Continued)

(52) U.S. Cl.
CPC ..... *H01R 9/223* (2013.01); *H01R 4/34* (2013.01); *H01R 11/12* (2013.01); *H01R 13/447* (2013.01); *H01R 25/162* (2013.01); *H01R 4/70* (2013.01)

(58) Field of Classification Search
CPC ..... H01R 25/162; H01R 25/12; H01R 9/223; H01R 4/34
See application file for complete search history.

(56) References Cited

U.S. PATENT DOCUMENTS 5,413,500 A 5/1995 Tanaka
5,439,759 A 8/1995 Lippert
7,530,843 B1 5/2009 Tesfay

FOREIGN PATENT DOCUMENTS

DE 102013005093 B3 5/2014
DE 102014203128 A1 8/2015
(Continued)

OTHER PUBLICATIONS

International Search Report for International Application No. PCT/FR2016/051747 dated Oct. 10, 2016.
(Continued)

*Primary Examiner* — Briggitte R. Hammond
(74) *Attorney, Agent, or Firm* — Pearne & Gordon LLP

(57) ABSTRACT

The application relates to an insulator (30) for an electrical connection (110) pivotable between a busbar (12) and at least one lug of a cable (25), the insulator (30) being suitable for being secured so as to be rotatably movable relative to the busbar (12). The insulator (30) includes a bottom (31), a wall (32) and an opening (33) near to said bottom for receiving a portion of the busbar (12). It is suitable for enabling the insertion of one side of said portion, and comprises the insertion portions suitable for preventing the insulator (30) from being separated from the busbar (12), and comprises a pivot structure suitable for being aligned
(Continued)

with a pivot structure of the busbar (12) when the insulator (30) and the busbar (12) are inserted together. The insulator (30) is also suitable for connections where two cables (25) are connected to the busbar (12).

7 Claims, 5 Drawing Sheets

(51) Int. Cl.

| | |
|---|---|
| ***H01R 11/12*** | (2006.01) |
| ***H01R 13/447*** | (2006.01) |
| ***H01R 25/16*** | (2006.01) |
| ***H01R 4/70*** | (2006.01) |

(56) References Cited

FOREIGN PATENT DOCUMENTS

| | | | |
|---|---|---|---|
| EP | 0603872 | A2 | 6/1994 |
| JP | 3691715 | B2 | 9/2005 |
| KR | 20130133634 | A | 12/2013 |

OTHER PUBLICATIONS

Preliminary French Search Report issued in Patent Application No. FR 15 56709 dated May 23, 2016.

INSULATOR FOR A PIVOTABLE ELECTRICAL CONNECTION

This is a National Stage application of PCT international application PCT/FR2016/051747, filed on Jul. 8, 2016 which claims the priority of French Patent Application No. 15 56709 entitled "INSULATOR FOR A PIVOTABLE ELECTRICAL CONNECTION", filed Jul. 16, 2015, both of which are incorporated herein by reference in their entirety.

TECHNICAL FIELD

The invention relates to the field of electrical power connection, and more specifically to the field of insulators for freely movable connections between busbars and electrical cables.

More particularly, the invention relates to an insulator adapted for a busbar, intended to be connected to at least one electrical cable with a lug in order to form a pivotable connection, and therefore enable relative rotation between them. The insulator of this invention is adapted to be rotatably mounted on a busbar, and rotatably together with at least one electrical cable rotatably mounted on the busbar.

PRIOR ART

The insulators for the electrical power connections between a busbar and a cable are well known. Generally, an insulating casing is supplied on the connection in order to protect it and in order to prevent the latter, or the conducting parts thereof, from being exposed.

An example of an insulator known for an electrical power connection between a busbar and a cable is described in patent application KR 2013 0133634 A. This document describes an insulator completely encasing such a connection.

Another example of an insulator known for an electrical connection between a busbar and a cable is described in patent JP 3691715 B2. The busbar is connected to the lug of the cable by a fastening element extending over an axis substantially perpendicular to a horizontal plane where the busbar and the cable with its lug are located. An insulator is provided for this connection, but it only allows for a single orientation between the busbar and the cable.

The aforementioned insulators however have defects. In the first example, the insulator completely encases the connection in order to protect it, but it is not connected to the connection itself. Consequently, there is a risk that the insulator can be disconnected from the connection.

In the second example, the insulator has a structure such that it prevents the cable from moving relatively to the busbar to find its natural position, particularly its natural angular orientation. In other words, the cable must be pulled or twisted in order to adapt to the structure of the insulator before it is inserted and connected in the sole possible orientation, which can then fold or stretch the cable, and as such damage it.

The insulators of prior art have other disadvantages. For example, they are comprised of many parts, which implies an increase in the installation time. They can also often be designed with fewer parts, generally not easy to install, and sometimes having to be installed without visibility.

Another defect of known insulators is linked to foreign object damage (FOD). The insulators have a non-negligible risk of causing FOD or being subjected to FOD. More particularly, a screw that has come loose from the insulator or from the connection, for example, can separate easily from the insulator or from the connection and can cause FOD. In addition, the insulators are comprised of numerous parts which increase this risk.

DISCLOSURE OF THE INVENTION

The object of this invention is consequently to overcome the aforementioned needs and disadvantages by proposing an insulator for a pivotable electrical connection, where the orientation of the insulator can be adjusted relative to a busbar, so as not to restrain the relative movement between the busbar and a lug when it is connected thereto, and as such prevent any problem of tension and of folding of the cable.

Another object is to provide an insulator that is simple to install by allowing the insulator to be mounted relatively to the busbar even before the lug, with its cable, is connected thereto in order to form the pivotable connection. Yet another object is to provide an insulator for a pivotable electrical connection that comprises fewer parts and that has anti-FOD characteristics, i.e. having a substantially reduced probability of causing FOD or of being subjected to FOD, such anti-FOD characteristics being, in particular in the aviation industry, highly sought.

This invention as such proposes an insulator for a pivotable electrical connection between a busbar and at least one lug of an electrical cable, said electrical connection enabling rotation relative to one another substantially in a plane and about an axis substantially perpendicular to this plane, the insulator adapted for being secured rotatably to the busbar so as to enable rotation in said plane and about said axis, the insulator comprising a bottom and a wall extending away from said bottom, characterised in that the insulator comprises an opening near said bottom, adapted for receiving a portion of the busbar, the insulator adapted for enabling the engagement of a first side of said portion of the busbar substantially facing the direction of said axis, the insulator comprising engagement portions adapted for engagement with the busbar in order to prevent the insulator from being separated from the busbar, the insulator further comprising a pivoting structure adapted for being aligned with a pivot structure of the busbar when the insulator and the busbar are engaged together, in order to allow the insulator and the busbar to be connected on said axis.

Preferably, the opening for receiving the busbar is defined between the wall and the bottom of the insulator.

Preferably, the insulator comprises a main body and a detachable receiver adapted for receiving the busbar, the receiver being rotatably connected to the main body.

Advantageously, the opening for receiving the busbar is mostly defined on the receiver.

Preferably, the insulator comprises a securing means adapted for engaging a second side of said portion of the busbar substantially facing the direction of said axis and being substantially opposite the first side, with the securing means comprising a ratchet system provided with a clip that cooperates with racks on the wall of the insulator in order to secure the insulator to the busbar.

Moreover, the invention also has for objective an insulated pivotable electrical connection assembly, characterised in that it comprises a connection between a busbar and at least one lug of an electrical cable allowing rotation relative to one another substantially in a plane and about an axis substantially perpendicular to this plane, and an insulator such as described hereinabove mounted to said connection.

Preferably, the insulator is secured so as to be rotatable relative to the busbar, and in that said at least one lug is secured relative to the busbar with a pivot element in order to form the pivotable connection, the pivot element axially connecting said at least one lug, the busbar and the insulator on said axis.

More preferably, the pivot element presses against a second side of said portion of the busbar substantially facing the direction of the axis and being substantially opposite the first side.

BRIEF DESCRIPTION OF THE DRAWINGS

It is described in what follows, by way of non-limiting examples, diagrammatically and partially, embodiments of the invention, by referring to the annexed drawing, wherein.

In all of these figures, identical references can designate identical or similar elements. Furthermore, the figures are not necessarily carried out according to a uniform scale, in order to make the figures easier to read.

DETAILED DESCRIPTION OF PARTICULAR EMBODIMENTS

Figure 1:
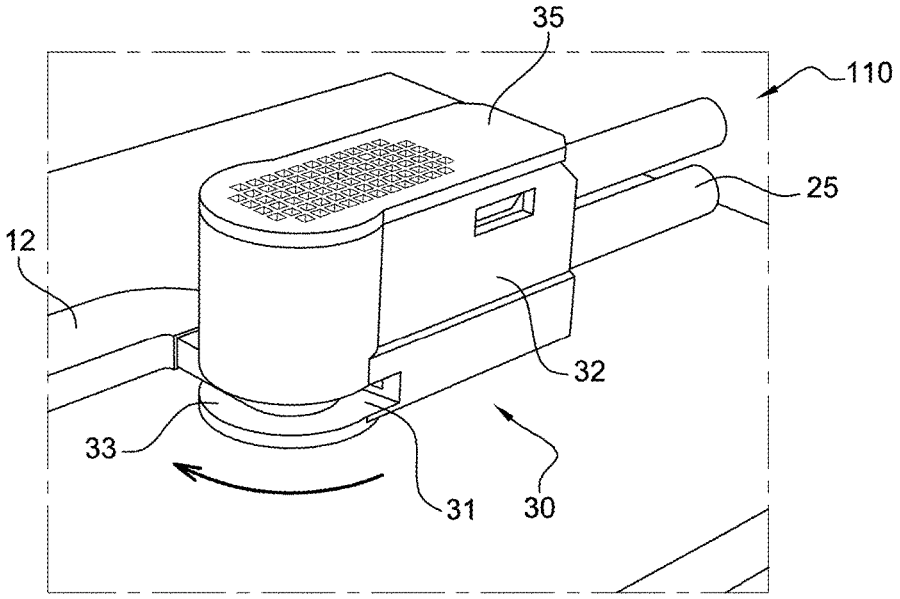
FIG. 1 shows a perspective view of an insulator when it is installed on a pivotable electrical connection according to a first embodiment of the invention.
Figure 2:
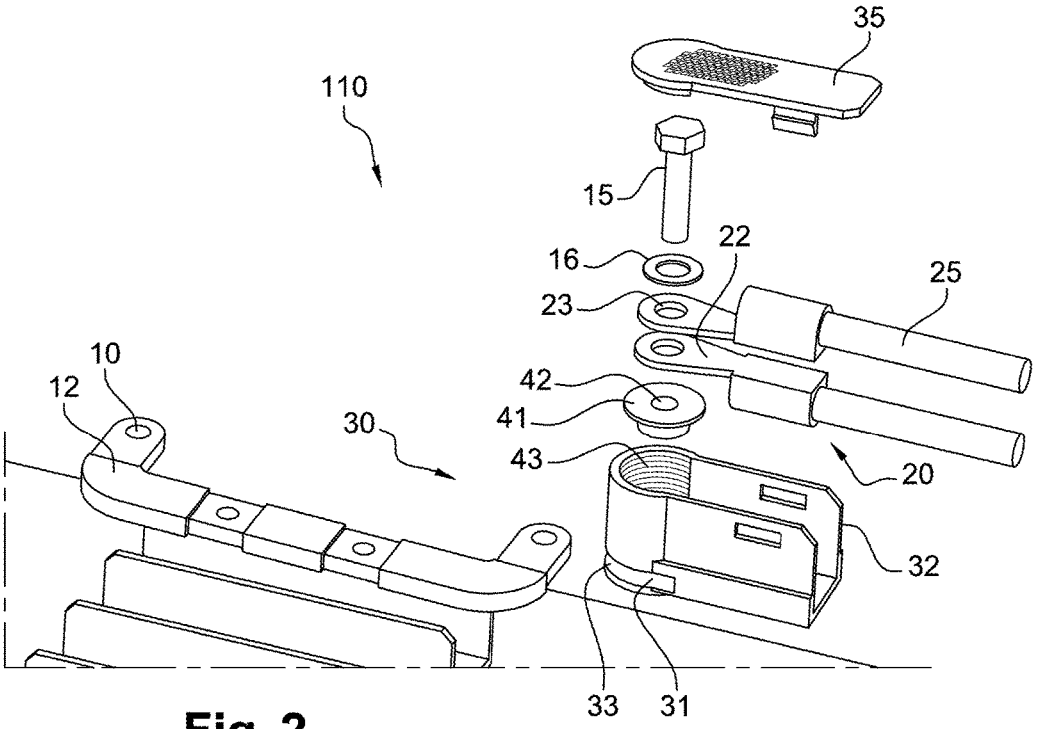
FIG. 2 shows an exploded view in perspective of the same insulator of FIG. 1, in such a way as to view the mounting relatively to the busbar.
Figure 3:
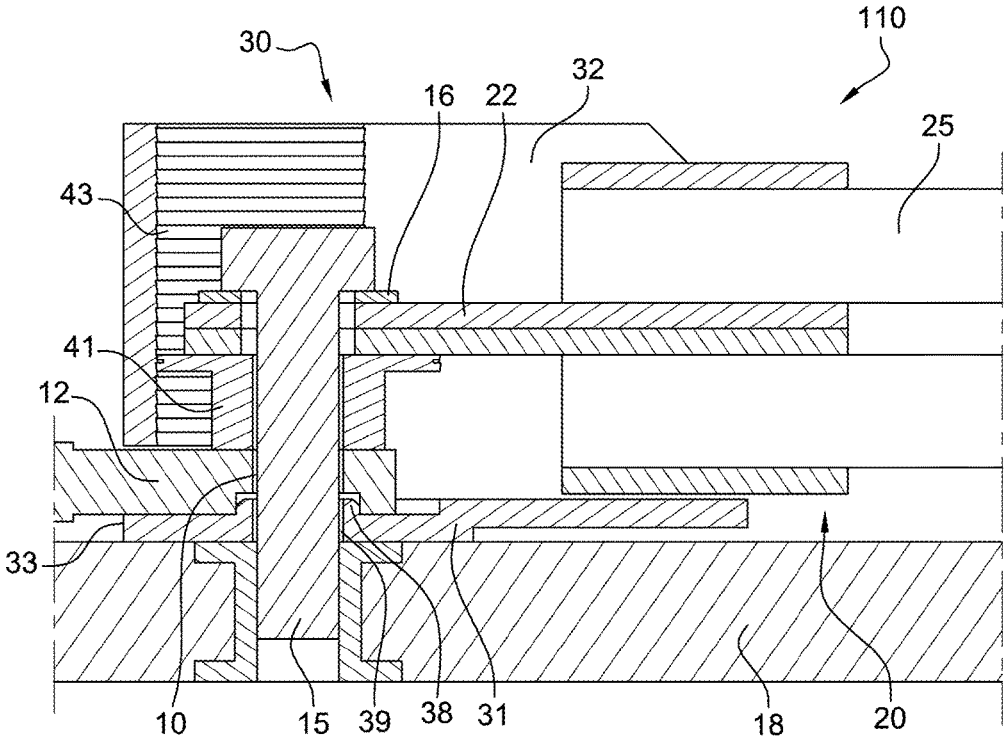
FIG. 3 shows a cross-section view of the insulator of FIG. 1, oriented slightly differently relative to the busbar and without a cover.
Figure 4:
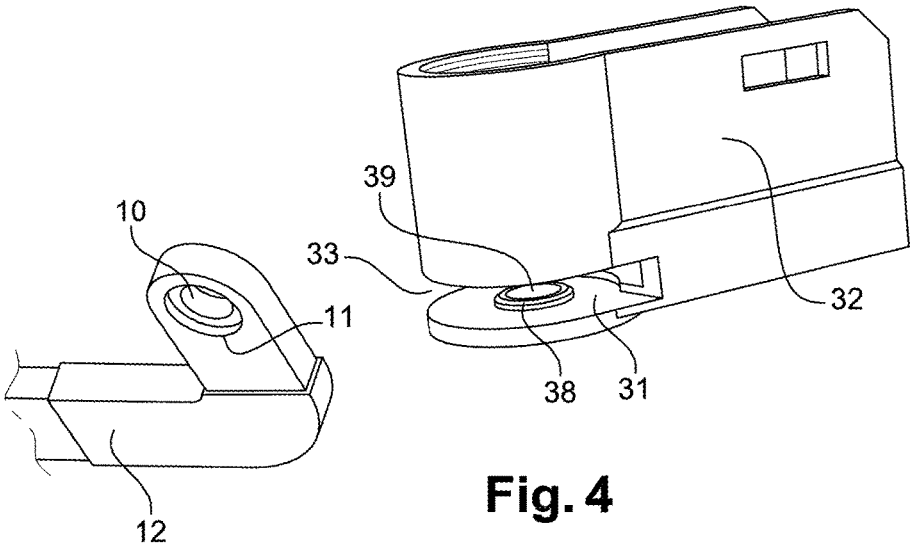
FIG. 4 shows a perspective view of the insulator of FIG. 1 showing the engagement portions on the insulator bottom intended for engagement with the engagement portions of the lower side of the busbar.

FIGS. 1 to 4 show a first embodiment of an insulator 30 installed on a pivotable electrical power connection 110 between a busbar 12 and two lugs 20 connected to the electrical cables 25. The connection 110 is of the type that enables the relative movement in rotation between the lugs 20 and the busbar 12 substantially in a plane and about an axis vertical substantially perpendicular to this plane. The insulator 30 is generally designed to protect and electrically insulate the connection 110 by placing a barrier or a separation between the exposed electrical parts of the connection and the environment thereof for reasons of safety and anti-FOD, for example in order to prevent a screw from becoming unscrewed and thus separating the connection or a tool of the installer from falling onto the connection and as such causing a short circuit.

The insulator 30 includes a bottom 31, and at least one wall 32 that extends away from the bottom 31 of the insulator 30. The bottom 31 is, in this case, unitary and substantially flat with a circular section, intended to enable engagement with the busbar 12, arranged at a rectangular section substantially in the shape of a keyhole. The wall 32 generally extends vertically from the bottom 31, substantially from the perimeter of the bottom 31, except for a portion of the rectangular section opposite the circular section.

Furthermore, the insulator 30 comprises an opening 33 in the vicinity of the bottom 31 in order to allow it to receive a busbar 12. The opening 33, which resembles a slot, is located along a section of the circumference of the circular section and under an arched section of the wall 32. This opening 33 (and therefore the insulator 30) is intended to receive a portion of a busbar 12 generally of the protruding type, for example, exiting from a surface of a composite panel 18 or from a piece of electrical equipment.

The bottom 31 of the insulator 30 comprises a pivot structure 39, in the form of a hole, coaxial with the axis of rotation, and engagement portions 38 in the form of a circular shoulder which protrudes at the upper surface of the bottom 31 substantially in the direction of the axis of rotation in a centred manner. The busbar 12 also has a pivoting structure, also in the form of a hole 10, coaxial with the axis of rotation, and the engagement portions 11 in the form of an internal circular counterbore 11 which extends in the direction of the axis of rotation in a centred manner. The shoulder 38 provided on the bottom 31 of the insulator 30 is adapted for engaging the internal counterbore 11 on the busbar, therefore having a size that is slightly smaller than the internal counterbore 11 of the busbar.

The insulator 30 is introduced relatively to the busbar 12 so that the latter is inserted substantially horizontally into the opening 33 and then brought closer to one another so that the shoulder 38 of the insulator and the internal counterbore 11 of the busbar are engaged with one another. Once carried out, the insulator 30 can rotate relative to the busbar 12 about the axis of rotation and in a plane. This axis and this plane are substantially the same as those of the connection 110 when a lug 20 is connected to the busbar 12. In addition, the holes 10, 39 are aligned in this position. The engagement between the insulator 30 and the busbar 12 resists, or prevents, them from separating, in particular in the direction of said plane.

It can be observed that the insulator 30 is also engaged with a first side, or surface, of the busbar 12 which faces the direction of the axis. In particular, the upper surface of the bottom 31 is engaged with a lower side of the busbar 12 in order to support it in the axial direction and as such resist or prevent the busbar 12 from separating from the insulator 30 by a movement downwards.

A clip 41 of the insulator is then installed for engagement or bearing against a second side of the busbar opposite the first side, which is the upper side. This clip is a securing means which is used to secure the shoulder 38 against the internal counterbore 11. In this embodiment, it is in the form of a circular disc with a central hole 42. The circumference of the disc is in engagement with the integrated rack 43 on an arched section of the wall 32 of the insulator and the two 41, 43 operating together like a ratchet system (therefore easier to insert than to take out), in order to resist or prevent the busbar 12 from separating from the insulator 30 by a movement upwards.

When the clip 41 is installed, the hole thereof is coaxial with the axis of rotation. The clip 41 also functions as a spacer in order to accommodate the shape, the thickness and/or the orientation of the lug 20. The lugs 20 of the two cables 25 are connected to the connection 110. The lugs 20, here of the type with a termination plate 22 slightly offset relative to the axis of the cable 25 and supplied with a connection hole 23, are mounted one on the other in the direction of the axis, and back-to-back. The clip 41 is made from a conductor of electricity, for example of metal, and is interposed between the busbar 12 and the lowermost of the two lugs 20 so that the termination plate 22 of the lug remains flat against the clip 41 which in turn remains flat against the busbar 12, in order to ensure good electrical engagement between the lug 20 and the busbar 12.

Of course, the insulator clip 41 can be designed for a single function. For example, if it is used solely as a spacer, the ratchet system would not necessarily be incorporated, and if it is used solely as a securing means for the busbar, it can be thinner. Of course, the clip 41 is not mandatory, for example if only a lug 20 oriented in the direction of the uppermost of the two lugs is connected to the connection 110.

A pivot element 15 is then inserted in order to connect the busbar 12 and the cables 25 on the axis of rotation. This pivot element 15 is a screw in this case, and is effectively the pivot of the connection that passes through the lugs 20, the clip 41, the busbar 12 and the insulator 30, and is secured on a composite panel 18 below the insulator 30. The washers 16 can be used to reduce the resistance between parts intended to rotate relative to one another. The insulator 30 is therefore secured so as to be rotatably movable in a reliable manner relative to the connection 110.

The insulator 30, as well as the lugs 20 that are attached thereto, can rotate relatively to the busbar 12, with a permitted rotation that depends on the width of the opening 33 and on the width of the busbar 12. By way of example, an angular orientation of 200° can be considered, for example ±100°.

Given that the insulator 30 is intended to electrically insulate the connection, it is therefore substantially made from a non-conducting material, for example from a composite material. Moreover, the wall 32 is designed to have a height that is greater than that of the connection 110. Ideally, the insulator 30 comprises a cover 35 in order to entirely enclose the conductive parts and to prevent the screw 15 from coming loose and from separating from the connection causing FOD.

Figure 5:
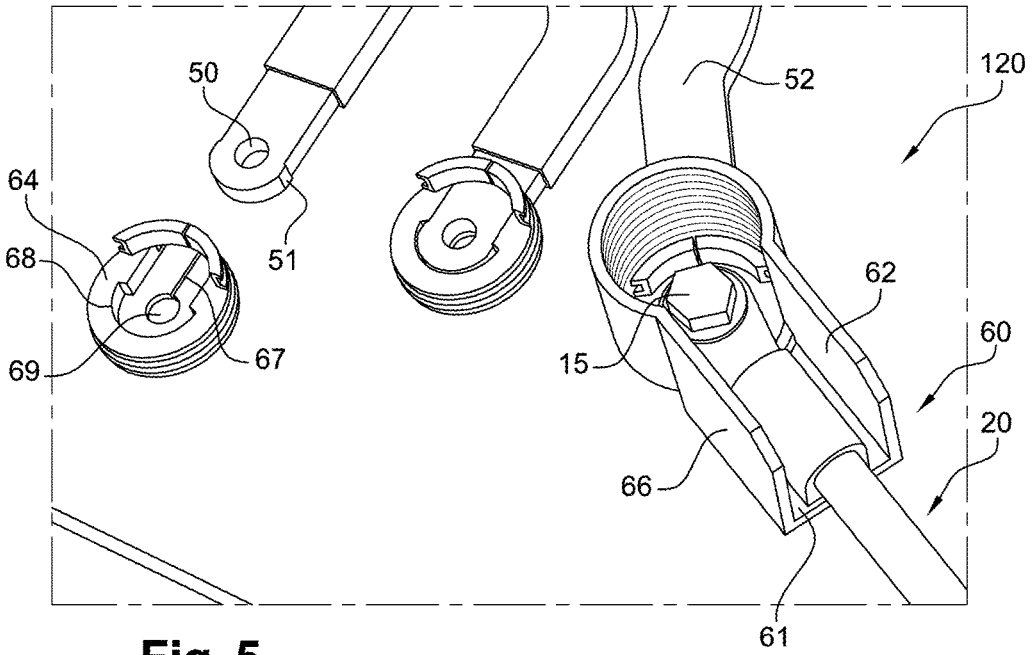
FIG. 5 shows a perspective view of an insulator when it is installed on a pivotable electrical connection according to a second embodiment of the invention, and also shows a busbar and a receiver before and after the connection.
Figure 6:
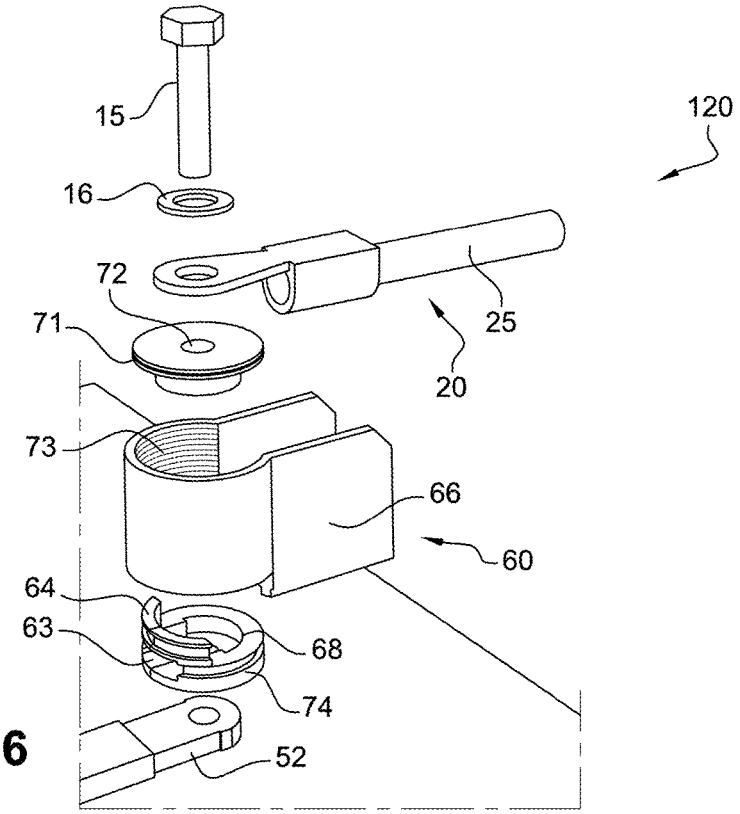
FIG. 6 shows an exploded view of the same insulator of FIG. 5, in such a way as to view the mounting relatively to the busbar, with the cable oriented differently and with a clip.
Figure 7:
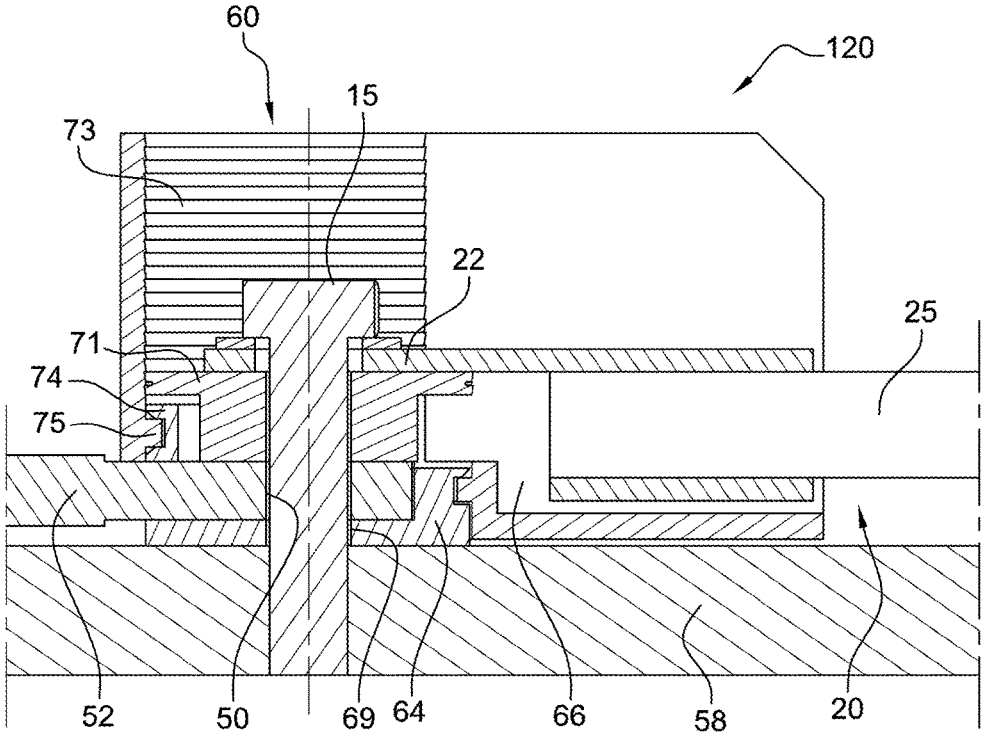
FIG. 7 shows a cross-section view of the insulator of FIG. 6.

FIGS. 5 to 7 show a second embodiment of an insulator 60 installed on an electrical power connection 120 pivotable between a busbar 52 and a lug 22 connected to the electrical cable 25. This insulator 60 is similar to that of the preceding embodiment comprising a bottom 61 and a wall 62 at least, but with a few differences relating to the engagement of the busbar 52. According to this embodiment, the insulator 60 comprises a receiver 64, which is essentially a portion of the bottom 61 of the insulator, which can be detached from the rest of the insulator 60, which is the main body 66 of the insulator. This makes it easier to insert the busbar 52 into the opening 63 of the insulator 60. The receiver 64 is substantially circular and is connected rotatably movable relative to the main copy 66. During the use, the receiver 64 will be connected in a fixed manner to the busbar 52 and therefore, it is more the main body 66 of the insulator 60 that will rotate relative to this receiver 64.

The receiver 64 is able to receive and engage with a portion of the busbar 52. It has the form of a disc with a portion for the engagement with a first side of the busbar that faces the direction of the axis, therefore the lower side, and has engagement portions 68 that resemble a socket for engaging complementary engagement portions 51 on the busbar 52. The receiver 64 further comprises a central hole 69. Grooves 74 are defined on the circumference of the receiver which snap fit or are inter-engaged with the ribs 75 on the insulator in such a way as to allow for the rotation between the two.

In this case, the busbar 52 generally has the shape of a bar with a rectangular section, and with engagement portions 51 such as a slightly enlarged semi-circular termination and with a hole 50. Supplied on the receiver 64, as in the preceding embodiment, are engagement portions 68 adapted for engagement with the engagement portions 51 of the busbar 52. The receiver 64 is presented to the busbar 52 so that it is inserted horizontally into the receiver 64 and so that it snap-fits to the busbar 52. When the two parts 64, 52 are engaged, the pivoting structure, namely the hole 69 on the insulator and the hole 50 on the busbar, will be aligned.

The receiver 64 comprises a recess 67 from its edge towards the hole thereof 69 in order to render it more elastic so as to receive the busbar 52 better and connect better with the main body 66 of the insulator. The receiver 64 is more preferably detached from the main body 66 of the insulator during its connection with the busbar 52. Once the receiver 64 is in engagement with the busbar 52, the main body 66 of the insulator can be mounted on the receiver 64, connected so as to be rotatably movable with the latter. Of course, the receiver 64 can contain the entire wall 61 of the insulator 60, the main body 66 therefore comprising mainly a wall 62.

As in the preceding embodiment, a clip 71 of the insulator can then be used for engaging with and pressing against the upper side of the busbar, opposite the first side, and be used as a spacer. This can be chosen according to the numbers, shapes and general orientations of the lugs of the cables to be connected. In contrast to FIG. 5 which shows a lug with the back downwards and arranged directly on the busbar, FIGS. 6 and 7 show a lug with the back upwards and therefore a spacer 71 in order to provide good engagement. However, the connection can make it possible to have more cables, as in the first embodiment.

Then, a pivot element 15, for example a screw, is installed to be used as a pivot in order to axially connect the busbar 52 and the lug 20 to a panel 58 underneath, in order to form the connection 120. The screw 15 can also assist in tightening, to a certain degree, the lug 20 against the busbar 52 and the insulator 60 to the connection 120, and facilitate the conduction of electricity.

It is considered that the insulator 60 of this embodiment, as shown in the figures, be capable, by way of example, of an angular orientation up to 200°, for example ±100°. The insulator 60 is designed in such a way that the main body 66 bears against the busbar 52 at the ends of the rotation. However, with a few small modifications, an angular orientation of 360° between the insulator 60 and the busbar 52 can be achieved. Furthermore, the receiver 64 and the main insulator body 66 are made from a non-conducting material, while the clip 71 is made from a material that conducts electricity. A cover can be incorporated where applicable.

Figure 8:
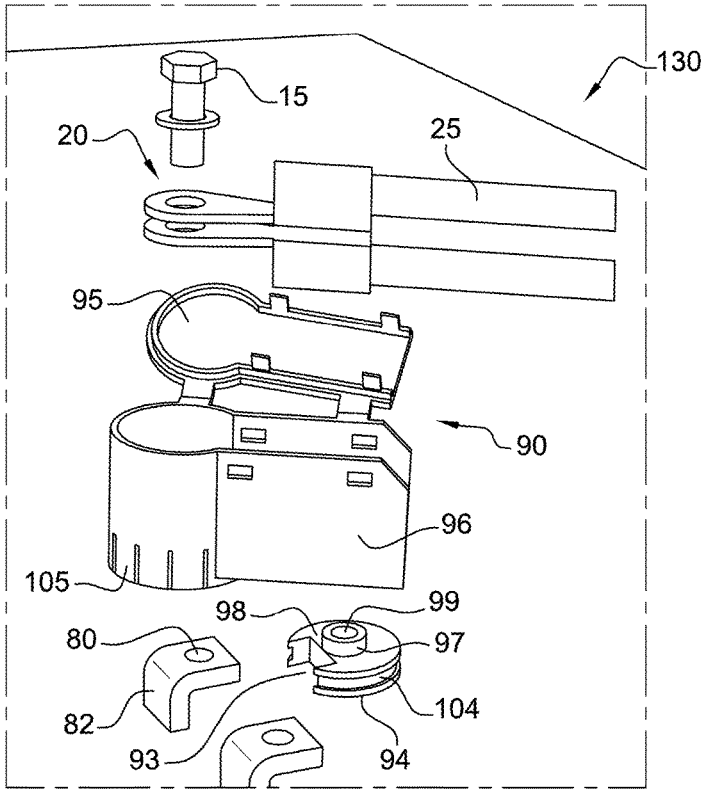
FIG. 8 shows an exploded view of an insulator according to a third embodiment of the invention, in such a way as to view the mounting relatively to the busbar.
Figure 9:
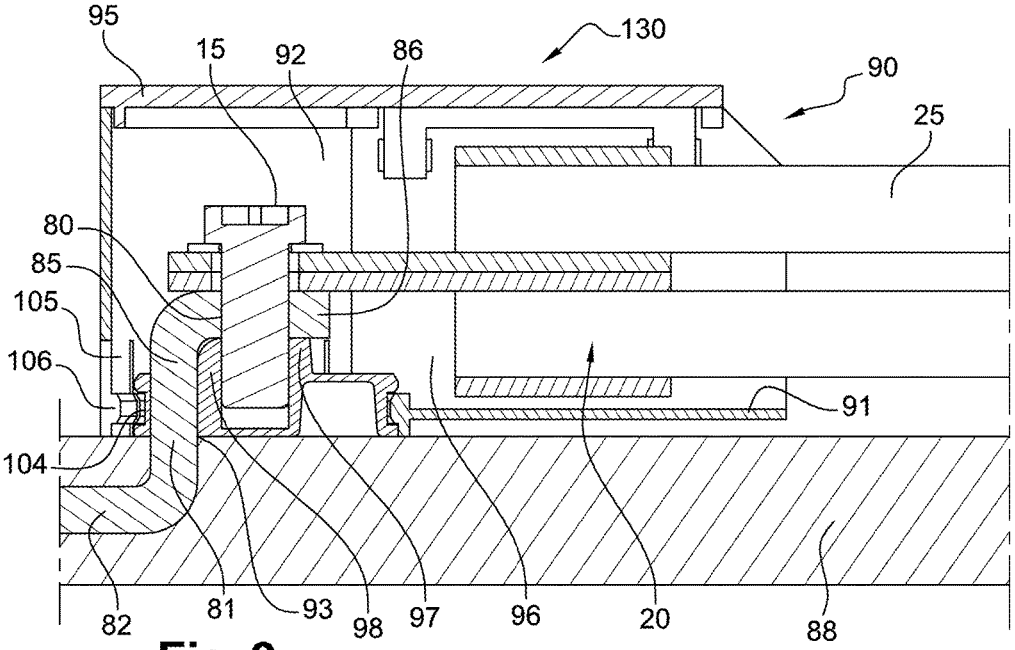
FIG. 9 shows a cross-section view of the same insulator of FIG. 8.

FIGS. 8 and 9 show a third embodiment of an insulator 90 installed on a pivotable electrical power connection 130. Although the two other embodiments hereinabove generally relate to external busbars protruding horizontally, this insulator 90 is designed rather for engagement with a busbar 82 that is protruding vertically, i.e. that exits from the surface of a panel 88 for a portion of its length in the direction of the axis of rotation.

The receiver 94 is adapted for engagement with the busbar 82, having a shape that allows it to receive and to press against the busbar 82. In this example, the receiver 94 is again substantially a portion of the bottom 91 of the insulator 90 and again substantially in the shape of a disc, except for a notch 93 at the edge thereof, along a section of the circumference thereof. The notch 93 is substantially rectangular, allowing the receiver 94 good engagement with a busbar 82 that substantially has a rectangular section extending vertically, for example from a honeycomb panel 88. The busbar 82, in turn, and as can be seen in the figures, has a rectangular section, and comprises engagement portions 81 taking the shape of a 7, i.e. with a vertical section 85 exiting from the composite panel, and a second section 86 that extends horizontally from this vertical section 85. The second section is provided with a hole 80.

The receiver 94 further comprises a shoulder 97 upwards intended for the engagement with the section 86 of the busbar which extends horizontally, and more particularly, a first side of the busbar that faces the axis of rotation, in this case, the lower surface of the section 86 of the busbar 82 extending horizontally. The receiver 94 is supplied with a blind hole 99, but it can be a through-hole in an alternative. The receiver 94 is slipped under the protruding busbar 82 so that the notch 93 engages with the vertical section 85 of the busbar, and the shoulder 97 is in engagement with the horizontal section 86. When the receiver is in this position, the two holes 80, 99 are aligned.

The main body 96 of the insulator is then installed for engagement with the receiver 94. The main body comprises engagement portions that enable it to cooperate with the receiver, so that they be attached to one another, but in a way that allows for rotation. There are other ways to provide this type of engagement, but in this case the main body of the insulator has a plurality of fingers 105 that extend downwards, with the fingers being provided with indentations 106 that snap-fit into a groove 104 around the circumference of the receiver 94. The individual fingers 105 are provided in order to provide a little elasticity downwards of the main insulator body 96 in order to facilitate engagement with the receiver 94. The elasticity is conferred on the main insulator body 96 instead of on the receiver 94.

Once the insulator 90 is assembled, i.e. the main body 96 and the receiver 94 are engaged together, it resists or prevents the busbar 82 from exiting, in particular in the direction of the plane of rotation. The busbar extends into the insulator via the opening defined mainly by the notch 93 and the wall 92 to a lesser degree. The engagement portions 98 on the receiver, more precisely the notch 93 and the shoulder 97 cooperate with the wall 92 in order to trap the busbar 82. Thanks in part to the face that the main body 96 of the insulator surrounding the entire portion of the protruding busbar 82, a rotation of 360° between the insulator 90 and the busbar 82 is achieved.

A pivot element 15 is supplied in order to secure the lugs 20 to the busbar. As the busbar 82 is already well secured on the composite panel, the pivot element 15 does not necessarily need to be secured to the composite panel 88 but just well secured to the busbar 82. Consequently, the receiver 94 is provided this time with only a blind hole 99. The pivot element 15 for the connection 130, which is a screw, passes through the lugs 20 of the cables to be connected to the connection 130 and the busbar 82, and is secured on the receiver 94. In this position, the screw 15 is used to support the second side of the busbar, which is the side of the busbar opposite the first side, and to pull the receiver 94 against the lower side of the busbar in order to secure the insulator 90 well to the busbar. Of course, a clip can be used if need be, for example, in order to improve the engagement with the busbar, or as a spacer for the assembly of two or more cables. Also, a through-hole can be supplied on the receiver 94 so that the fastening element 15 can be inserted into the composite panel 88 underneath. A cover 95 is pivoted on the main body 96 of the insulator, and they are made from a non-contacting material.

When reading the three aforementioned embodiments of the invention, it will be clear that the insulator of the invention is practical to install on a busbar, and on a pivotable connection between a busbar and a lug, in such a way as to provide a certain cabling freedom. It makes it possible to insulate and to protect a pivotable connection, while still remaining rotatably movable on the connection. The fact that it encases solely or substantially the substantial portion of the connection implies that it can be produced in a small size which does not obstruct the other surrounding connections.

The insulator can be mounted on a new pivotable connection, and also retrospectively on existing pivotable connections. Moreover, it can be mounted before the connection is made, and can advantageously be left in a secure manner on the busbar, for example, in order to replace the cables. The insulator is designed in such a way that it can be mounted and secured on a busbar, even before the pivot element is installed. This practical system allows an installer to first mount the insulator on the busbar then to complete the connection with the cables.

The invention furthermore has anti-FOD characteristics. The insulator is designed with few elements, and is not easily separated from the busbar, or from the connection, to which it is connected. The cover of the insulator also contributes to this advantage. In the case where the screw of the pivot element comes loose, the cover would prevent it from fully exiting and the screw will as such be contained in the hole thereof. At the same time, the insulator protects the connection from an FOD event, for example, a tool of the installer falling on the connection.

The embodiments described hereinabove are described by way of examples and must not be interpreted in a limiting way. Note that other embodiments or improvements to the invention will be obvious to those skilled in the art without departing from the general scope of the claims.

For example, the pivoting structures on the busbar and the bottom are not necessarily through-holes. They can be formed by a recess, or a blind hole, in certain suitable cases. Also, another element in place of a screw can be used as a pivot element.

The fact that the insulator is adapted for a pivotable electrical connection does not restrict the appropriation thereof for a connection that does not pivot. Moreover, it can be locked in rotation by strongly tightening the screw, once the cable with its lug is installed in its natural position.

The insulator can be alternatively made of a material that is not very rigid in order to confer elasticity in order to facilitate the connection to the receiver.

Note that the expressions "direction of the axis" and "the direction of the plane" do not necessarily means that the direction is along the same axis or the same plane, but can be along a parallel axis or a parallel plane extending in the same direction.

Note that the expression "engagement/pressing . . . a side of the bulbar" does not necessarily imply a direct contact, for example, a termination of a lug or a washer can be interposed.

What is claimed is:

1. Insulator for a pivotable electrical connection between a busbar and at least one lug of an electrical cable, said electrical connection enabling rotation relative to one another substantially in a plane and about an axis substantially perpendicular to this plane, the insulator adapted for being secured rotatably to the busbar so as to enable rotation in said plane and about said axis, the insulator comprising a bottom and a wall extending from said bottom, wherein the insulator comprises an opening near said bottom, adapted for receiving a portion of the busbar, the insulator comprising an upward facing surface adapted for contacting a lower side of said portion of the busbar substantially facing a direction of said axis, the insulator comprising engagement portions adapted for engagement with the busbar in order to prevent the insulator from being separated from the busbar, the insulator further comprising a pivoting structure adapted for being aligned with a pivoting structure of the busbar when the insulator and the busbar are engaged together, in order to allow the insulator and to the busbar to be connected on said axis and further comprising a securing means adapted for engaging a second side of said portion of the busbar substantially facing the direction of said axis and being substantially opposite the first side, with the securing means comprising a ratchet system provided with a clip that cooperates with racks on the wall of the insulator in order to secure the insulator to the busbar.

2. Insulator according to claim 1, wherein the opening for receiving the busbar is defined between the wall and the bottom of the insulator.

3. Insulator according to claim 1, comprising a main body and a detachable receiver adapted for receiving the busbar, the receiver being rotatably connected to the main body.

4. Insulator according to claim 3, wherein the opening for receiving the busbar is mostly defined on the receiver.

5. An insulated pivotable electrical connection assembly, comprising:

a connection between a busbar and at least one lug of an electrical cable enabling rotation relative to one another substantially in a plane and about an axis substantially perpendicular to this plane, and an insulator mounted to said connection, the insulator adapted for being secured rotatably to the busbar so as to enable rotation in said plane and about said axis, the insulator comprising a bottom and a wall extending from said bottom, wherein the insulator comprises an opening near said bottom, adapted for receiving a portion of the busbar, the insulator adapted for enabling the engagement of a first side of said portion of the busbar substantially facing the direction of said axis, the insulator comprising engagement portions adapted for engagement with the busbar in order to prevent the insulator from being separated from the busbar, the insulator further comprising a pivoting structure adapted for being aligned with a pivoting structure of the busbar when the insulator and the busbar are engaged together, in order to allow the insulator and to the busbar to be connected on said axis.

6. Assembly according to claim 5, wherein the insulator is secured so as to be rotatable relative to the busbar, and in that said at least one lug is secured relative to the busbar with a pivot element in order to form the pivotable connection, the pivot element axially connecting said at least one lug, the busbar and the insulator on said axis.

7. Assembly according to claim 6, wherein the pivot element bears against a second side of said portion of the busbar substantially facing the direction of the axis and being substantially opposite the first side.

* * * * *